United States Patent [19]

Velechovsky

[11] Patent Number: 5,060,699

[45] Date of Patent: Oct. 29, 1991

[54] DEVICE FOR AUTOMATIC REMOVAL OF MISPICKED WEFT

[75] Inventor: Petr Velechovsky, Liberec, Czechoslovakia

[73] Assignee: Elitex Liberec, Czechoslovakia

[21] Appl. No.: 543,215

[22] Filed: Jun. 25, 1990

[30] Foreign Application Priority Data

Jun. 27, 1989 [CS] Czechoslovakia ..... 3859-89

[51] Int. Cl.[5] ..... D03D 47/30

[52] U.S. Cl. ..... 139/116.2

[58] Field of Search ..... 139/116.2, 1 R

[56] References Cited

U.S. PATENT DOCUMENTS 4,502,512 3/1985 Suzuki et al. .
4,503,889 5/1985 van Mullekom .
4,635,686 1/1987 Terasaki .
4,664,157 5/1987 Shin ..... 139/116.2
4,688,606 8/1987 Tamatani ..... 139/116.2
4,749,006 6/1988 Miyamoto ..... 139/116.2
4,899,788 2/1990 Aarts ..... 139/116.2

FOREIGN PATENT DOCUMENTS 3319059 12/1983 Fed. Rep. of Germany .

*Primary Examiner*—Andrew M. Falik
*Attorney, Agent, or Firm*—Ostrolenk, Faber, Gerb & Soffen

[57] ABSTRACT

A device for automatically removing a mispicked weft on a weaving machine. A hook fixed to a rotary shaft is rotated to raise the weft off the woven fabric and between two rotatable discs. A holding nozzle supported on the hook blows air against the hook to hold the lifted web in the hook. The rotatable discs include a relatively stationary and relatively axially moveable disc. After the hook draws the web between them, the discs are moved together and when they rotate they pull on the weft. A servomotor controls the hook moving shaft.

7 Claims, 2 Drawing Sheets

DEVICE FOR AUTOMATIC REMOVAL OF MISPICKED WEFT

BACKGROUND OF THE INVENTION

The invention relates to a device for automatic removal of mispicked weft on weaving machines.

One known device for removal of mispicked weft consists of a rotary stripping brush which operates to release the mispicked weft from the beat-up line. The mispicked weft is then transferred, by means of feed nozzles into the pick channel and there is either sucked off or blown out. The drawback of this solution is that the course of the released weft removal is not reliable and definite.

SUMMARY OF THE INVENTION

The device according to the present invention for automatic removal of mispicked weft is intended to eliminate this drawback of the known device. The device comprises a hook spaced away from but fixed to a rotatable shaft. Rotation of the shaft is controlled by a servo motor. The hook carries a holding nozzle, which blows air onto the hook to hold the raised weft in the hook. The holding nozzle comprises an outlet of a tube that is fixed to the hook, and the nozzle is corrected to a source of pressurized air. A stationary drive disc on a common shaft cooperates with an axially sliding driven disc on that shaft, and the sliding disc is slid to the stationary drive disc for clamping the mispicked weft between the discs. The common shaft is rotatable. Both the drive disc and the driven disc are situated in front of the hook so that the hook draws the mispicked weft between the discs. The entire device is seated on a base plate over the woven fabric.

The invention has the primary advantage that the released weft is reliably gripped with the hook aided by the holding nozzle, and the weft is reliably transferred and pulled out of the shed between the drive and the driven disc, so that the whole procedure of misplaced weft removal from the shed is reliable. The invention permits removal of any number of wefts on any type of weaving machine without reducing the operating speed of the machine.

Other features and advantages of the present invention will become apparent from the following description of the invention which refers to the accompanying drawings.

BRIEF DESCRIPTION OF THE DRAWINGS

An embodiment of the invention is disclosed, by way of example, in the following description with reference to the drawings in which.

DESCRIPTION OF THE PREFERRED EMBODIMENT

Figure 1:
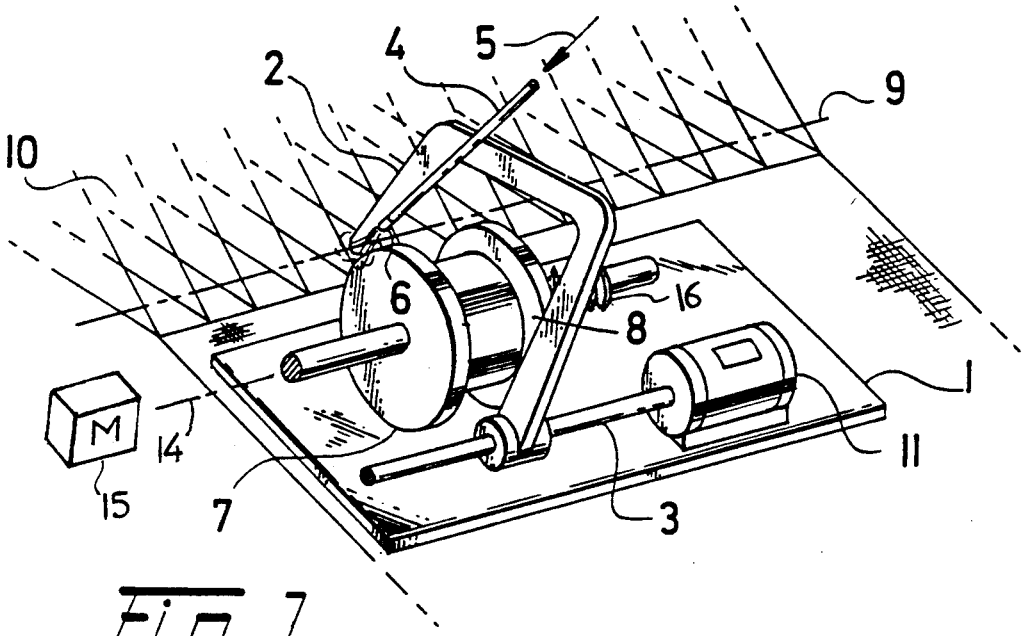
FIG. 1 is a schematic perspective view of the device according to the invention at the beginning of the process of removing the mispicked weft.

The device according to the invention is seated on a base plate 1 which is situated over the woven fabric at a warp shed on a holder, not shown, of an inlet temple of a weaving machine. The device comprises a hook 2, which includes a lever that is fixed to a shaft 3, the shaft being shown schematically. The shaft 3 is connected to a servomotor 11, which is selectively operable to rotate the shaft and swing the hook around the shaft as an axis.

A tube 4 is attached to the body of the hook 2. The tube is coupled with a supply line for pressurized air. The outlet of the tube 4 serves as a holding nozzle 6 of the hook 2 and blows air to hold the weft on the hook.

A drive disc 7 is mounted for rotation on a common shaft 14. There is a driven disc 8 on the common shaft 14 which is axially slidable, for instance by means of a bellows 16, to press a weft against the drive disc 7. The shaft 14 is connected with an electric motor 15 which rotates the shaft.

In the first stage of the separation cycle, the weaving machine is stopped due to a signal from a sensor of a not represented weft stop motion. This either prevents the following weft (not shown) from being picked or, if the pick of the following weft does take place, this picked following weft is removed, for instance by being blown out of the shed by means of a known nozzle, also not shown, which blows air transversely to the pick axis.

The beaten up and cut off weft 9 that is shown is then released, for instance by the reverse motion of the shafts 3 and 14, and removed from the beat up line, for instance by means of a rotary brush, not shown. The hook 2 grabs the weft 9 in the shed, and the hook is then turned from its position in the warp shed 10 to its operative position of FIG. 3 by the servomotor 11. The released weft 9 is fixed in the bend of the hook 2 by the pressurized air flowing out of the holding nozzle 6.

Figure 2:
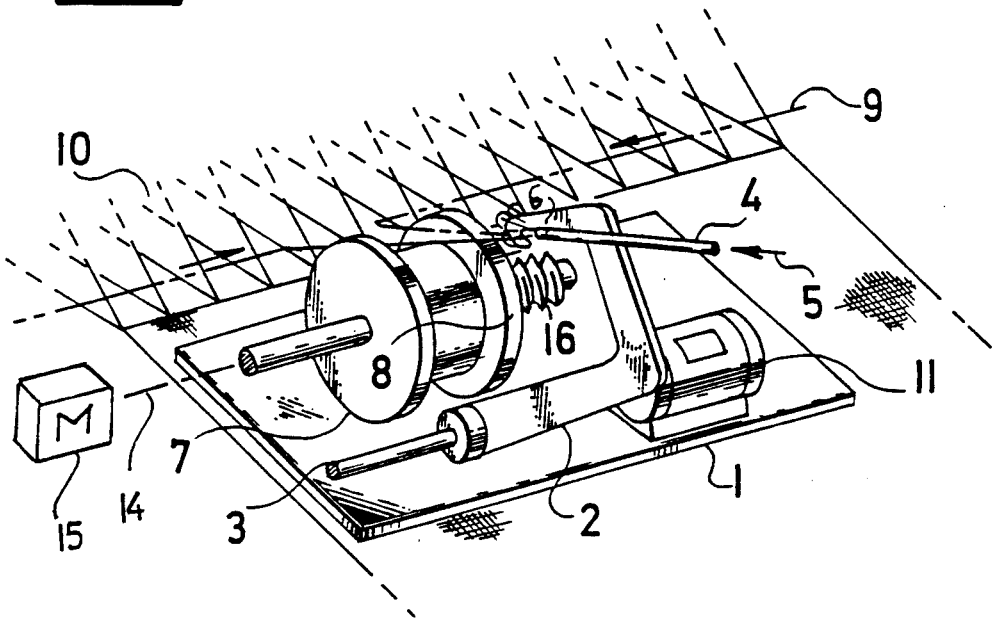
FIG. 2 is the same type of view as FIG. 1 at a subsequent stage of removing the mispicked weft.
Figure 3:
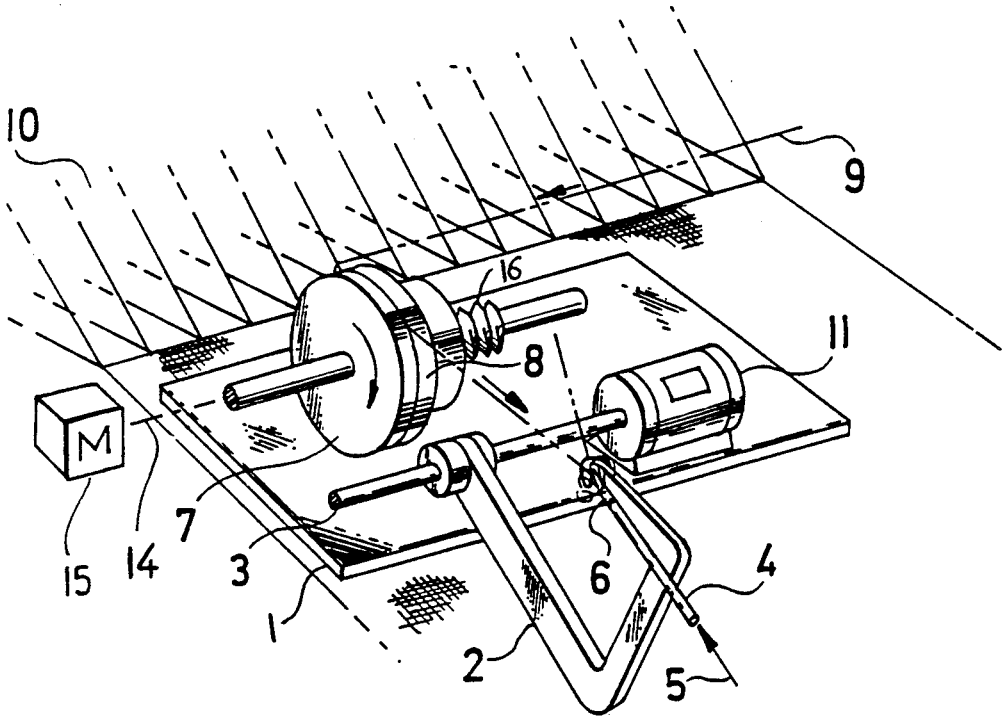
FIG. 3 is the same type of view as FIG. 1 with the hook returned to its initial position.

The reverse turning or swinging motion of the hook 2 on the shaft 3 from the position of FIG. 1 toward that of FIG. 3 draws the weft 9 out between the shed 10 in the shape of a loop (FIG. 2) The air blast from the holding nozzle 6 reliably holds the weft 9 on the hook 2. When the hook 2 is returned to its initial up position (FIG. 3), the weft 9 is drawn between and is tensioned between the drive disc 7 and the driven disc 8. The discs 7 and 8 are normally in front of the hook 2 so that the hook draws the weft 9 between the discs. The drive disc 7, connected through the shaft 14 with the electric motor 15 begins to rotate, and the driven disc 8 on the shaft is pressed to the drive disc 7 by an appropriate mechanism, for instance, by an air bellows 16. The weft 9 is gripped between the driven disc 8 and the drive disc 7, and by rotation of these gripping discs on the shaft 14, the weft 9 is drawn off the shed 10. The whole operational cycle can be repeated a number of times.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A device for automatic removal of a mispicked weft on a weaving machine, the device comprising:

a hook and means supporting the hook over the fabric being woven, means for moving the hook from a position at the fabric to be woven, where the hook can pick a mispicked weft up onto the hook, and move the weft to a position with the hook away from the fabric;

a holding nozzle for blowing air and the nozzle having an outlet aimed into the hook for blowing air onto the weft in the hook for retaining the weft in the hook;

relatively moveable drive discs normally positioned apart and at a location such that the hook is moveable for moving the mispicked weft, which is picked up by the hook, between the discs, and means for moving the discs together against the weft when the mispicked weft is between them;

means for rotating the discs when the discs are together for pulling upon the weft clamped between the discs.

2. The device of claim 1, further comprising the discs being rotatable on an axis and one of the discs being relatively moveable toward and away from the other disc along the axis for selectively clamping the discs together to clamp the weft and moving the discs apart for enabling the weft to be moved by the hook through the space between the discs.

3. The device of claim 2, wherein the hook moving means comprises a rotatable shaft, and the hook being secured to and extending away from the rotatable shaft; means for rotating the shaft, such that rotation of the shaft in one direction moves the hook to move the weft away from the fabric being woven.

4. The device of claim 3, further comprising a servomotor connected with the shaft for the hook for rotating the hook shaft to move the hook.

5. The device of claim 1, further comprising a tube attached to the hook and the holding nozzle located on the tube and the nozzle directed to the hook, the tube being connectable with a source of pressurized air.

6. The device of claim 1, wherein both of the discs are situated in front of the hook, so that the hook may draw the web between the discs when the hook is moved away from the woven fabric.

7. The device of claim 1, further comprising a base; plate seated over the woven fabric, the hook and the discs being supported on and being moveable with respect to the base plate.

* * * * *